US012276197B2

(12) United States Patent
Sekiyama et al.

(10) Patent No.: US 12,276,197 B2
(45) Date of Patent: Apr. 15, 2025

(54) TUNNEL EXCAVATION DEVICE

(71) Applicant: KOMATSU LTD., Tokyo (JP)

(72) Inventors: Naoki Sekiyama, Tokyo (JP); Hiroshi Asano, Tokyo (JP); Taku Arakawa, Tokyo (JP); Shinichi Terada, Tokyo (JP); Eiichi Morioka, Tokyo (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 17/909,868

(22) PCT Filed: Feb. 26, 2021

(86) PCT No.: PCT/JP2021/007252
§ 371 (c)(1),
(2) Date: Sep. 7, 2022

(87) PCT Pub. No.: WO2021/192809
PCT Pub. Date: Sep. 30, 2021

(65) Prior Publication Data

US 2024/0200450 A1 Jun. 20, 2024

(30) Foreign Application Priority Data

Mar. 27, 2020 (JP) ..... 2020-058002

(51) Int. Cl.
*E21D 9/10* (2006.01)
*E21D 9/11* (2006.01)

(52) U.S. Cl.
CPC ..... *E21D 9/1093* (2013.01); *E21D 9/112* (2013.01)

(58) Field of Classification Search
CPC ..... E21D 9/1093; E21D 9/112; E21D 9/06
See application file for complete search history.

(56) References Cited

U.S. PATENT DOCUMENTS 5,205,613 A * 4/1993 Brown, Jr. ..... E21D 9/1093 299/33
5,765,925 A * 6/1998 Kondo ..... E21D 9/112 405/141
6,206,478 B1 3/2001 Uehara et al.
(Continued)

FOREIGN PATENT DOCUMENTS

CN 1389642 A 1/2003
CN 104395555 A 3/2015
(Continued)

OTHER PUBLICATIONS

The Examination report No. 1 for the corresponding Australian application No. 2021242899, dated Sep. 28, 2023.
(Continued)

*Primary Examiner* — Carib A Oquendo
(74) *Attorney, Agent, or Firm* — GLOBAL IP COUNSELORS, LLP

(57) ABSTRACT

A tunnel excavation device includes a front body portion configured to support a cutter head and a rear body portion. The rear body portion includes a gripper carrier and a gripper portion. The gripper carrier is disposed in a rear of the front body portion. The gripper portion is provided on the gripper carrier. The gripper portion includes a groove portion and a wheel portion. The groove portion is formed in a recess shape toward the rear main body. The wheel portion is disposed in the groove portion.

11 Claims, 18 Drawing Sheets

(56) References Cited

U.S. PATENT DOCUMENTS

| | | | | |
|---|---|---|---|---|
| 2002/0189138 | A1 | 12/2002 | Yoshimoto | |
| 2011/0103892 | A1* | 5/2011 | McNally | E21D 9/04 405/141 |
| 2015/0078831 | A1 | 3/2015 | Kawai et al. | |

FOREIGN PATENT DOCUMENTS

| | | | |
|---|---|---|---|
| CN | 110332006 | A | 10/2019 |
| JP | 60-109497 | A | 6/1985 |
| JP | 61-106896 | A | 5/1986 |
| JP | 2-37994 | U | 3/1990 |
| JP | 4-92078 | A | 3/1992 |
| JP | 9-100694 | A | 4/1997 |
| JP | 10-220181 | A | 8/1998 |
| JP | 10-311198 | A | 11/1998 |
| JP | 11-336473 | A | 12/1999 |
| JP | 11-336484 | A | 12/1999 |
| JP | 2001-20673 | A | 1/2001 |
| JP | 2003-172100 | A | 6/2003 |
| JP | 2003-336488 | A | 11/2003 |
| JP | 2014-129667 | A | 7/2014 |

OTHER PUBLICATIONS

Examination report No. 2 for the corresponding Australian application No. 2021242899, issued on Jan. 24, 2024.

The International Search Report for the corresponding international application No. PCT/JP2021/007252, issued on Apr. 6, 2021.

The Office Action for the corresponding Chinese application No. 202180013187.7 issued on Sep. 23, 2024.

Chiou Linbin et al., Case Study of Rock Tunnel Excavated by Slurry Type TBM, vol. 30 Sup. 1, Aug. 2010.

* cited by examiner

STEP S1

STEP S2

STEP S3

STEP S4

STEP S5

STEP S6

STEP S7

STEP S8

TUNNEL EXCAVATION DEVICE

CROSS-REFERENCE TO RELATED APPLICATIONS

This application is a U.S. National stage application of International Application No. PCT/JP2021/007252, filed on Feb. 26, 2021. This U.S. National stage application claims priority under 35 U.S.C. § 119(a) to Japanese Patent Application No. 2020-058002, filed in Japan on Mar. 27, 2020, the entire contents of which are hereby incorporated herein by reference.

TECHNICAL FIELD

The present disclosure relates to a tunnel excavation device.

BACKGROUND ART

Conventionally, a tunnel excavation device is used for excavating bedrock in a civil engineering work. The tunnel excavation device includes a cutter head including a cutter on a front surface of a machine and a gripper device provided on left and right side surfaces of a rear portion of the machine (see, for example, Japanese Laid-open Patent H10-220181).

In such a tunnel excavation device, the left and right gripper devices are pressed against left and right side walls of a tunnel. In this state, the cutter head is pressed against the bedrock by extending a thrust cylinder while rotating the cutter head. Thereby, the bedrock is excavated.

Here, when the extension amount of the thrust cylinder reaches a predetermined amount, an excavation work of the bedrock is interrupted and the tunnel excavation device moves forward. After that, the excavation work of the bedrock is restarted. The tunnel is formed by repeatedly excavating the bedrock.

SUMMARY

With the conventional tunnel excavation device, when the extension amount of the thrust cylinder reaches the predetermined amount, it is necessary to move forward the tunnel excavation device. Therefore, in general, traveling wheels are provided on the tunnel excavation device. However, when the traveling wheels are mounted on an outer peripheral surface of the tunnel excavation device, the tunnel excavation device might become larger in a radial direction.

An object of the present disclosure is to provide a tunnel excavation device which can reduce a radial dimension.

MEANS FOR RESOLVING THE PROBLEM

A tunnel excavation device according to the present disclosure includes a front body portion and a rear body portion. The front body portion is configured to support a cutter head. The rear body portion includes a rear main body and a gripper. The rear main body is disposed in the rear of the front body portion. The gripper portion is provided on the rear main body to obtain a reaction force during an excavation. The gripper portion includes a groove portion and a wheel portion. The groove portion is formed in a recess shape toward the rear main body. The wheel portion is disposed in the groove portion.

According to the present disclosure, a tunnel excavation device can reduce a radial dimension.

DESCRIPTION OF EMBODIMENTS

Hereinafter, the tunnel excavation device 1 according to the present disclosure will be described with reference to the drawings. The tunnel excavation device 1 of the present embodiment is called a TBM (Tunnel Boring Machine). For example, the TBM includes a gripper TBM and a hard rock TBM. The tunnel excavation device 1 of the present embodiment is used not only for an excavation for a civil engineering work but also for an excavation of a mine.

(Overall Configuration of a Tunnel Excavation Device)

Figure 1:
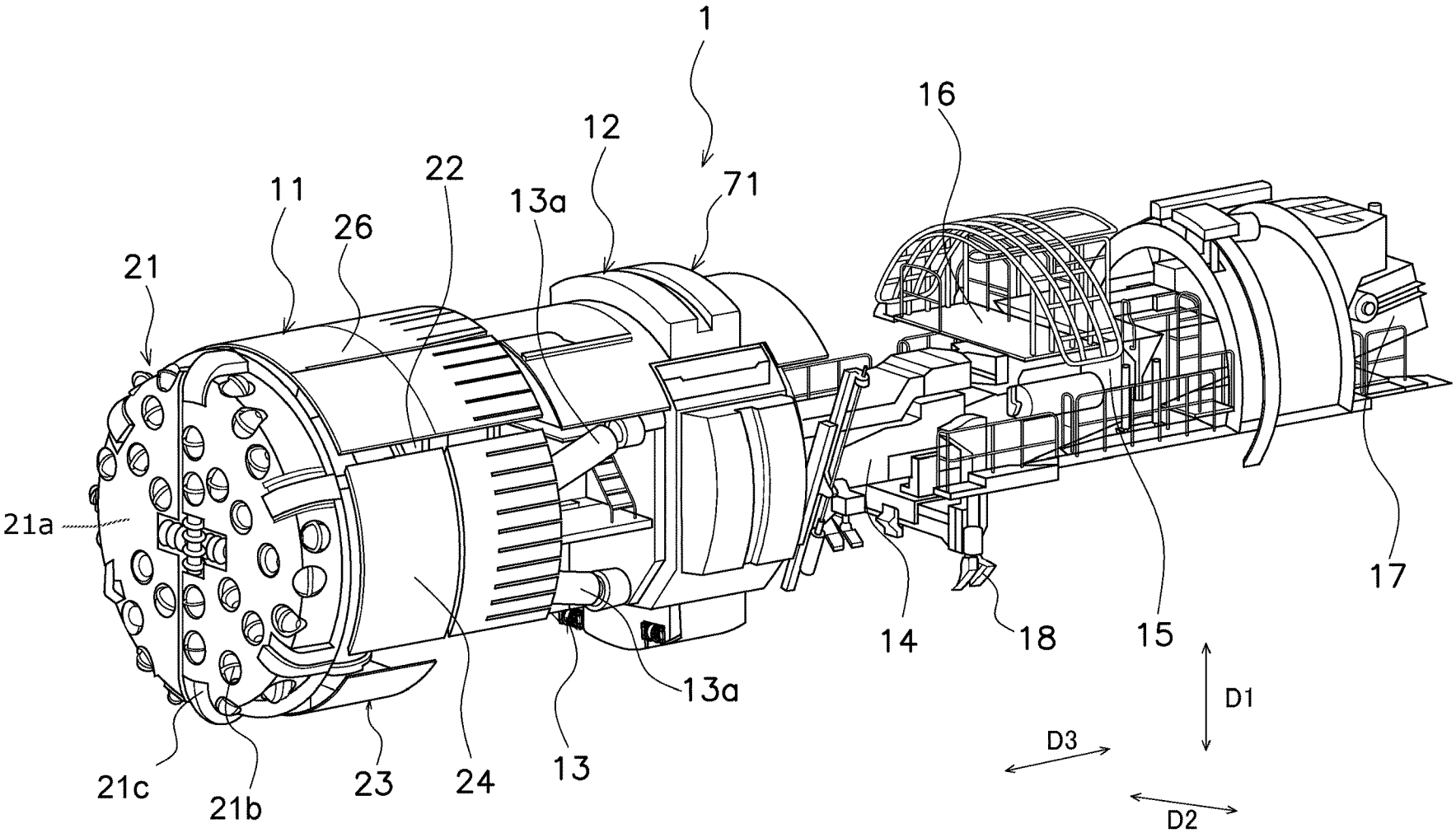
FIG. 1 is a perspective view showing a configuration of a tunnel excavation device according to an embodiment of the present disclosure.

FIG. 1 is a perspective view showing the tunnel excavation device 1 of the present embodiment. The tunnel excavation device 1 of the present embodiment excavates by rotating a cutter head 21 while being supported on an inner wall of a tunnel by a gripper portion 71.

As shown in FIG. 1, the tunnel excavation device 1 includes a front body portion 11, a rear body portion 12, a connecting portion 13, a main beam 14, a gantry 15, a workbench 16, a belt conveyor 17, and a rear support 18.

The front body portion 11 includes the cutter head 21 at the front end thereof. The cutter head 21 excavates a bedrock. The rear body portion 12 is disposed in the rear of the front body portion 11. The rear body portion 12 includes the gripper portion 71. The gripper portion 71 presses the inner wall of the tunnel to obtain a reaction during the excavation.

The connecting portion 13 connects the front body portion 11 and the rear body portion 12. Specifically, the connecting portion 13 connects the front body portion 11 and the rear body portion 12 so that the front body portion 11 is bent with respect to the rear body portion 12. The connecting portion 13 includes a plurality of thrust cylinders 13*a*. One end of each of the plurality of thrust cylinders 13*a* is rotatably connected to the front body portion 11. The other end of each of the plurality of thrust cylinders 13*a* is rotatably connected to the rear body portion 12.

The main beam 14 extends rearward from the rear body portion 12. The gantry 15 is rotatably mounted to a rear end of the main beam 14. The workbench 16 is provided to perform a net setting work on the inner wall of the tunnel after the excavation. The workbench 16 is disposed above the gantry 15.

The belt conveyor 17 extends from the front body portion 11 through the rear body portion 12 to a lower side of the gantry 15. The belt conveyor 17 conveys rearward bedrocks, earth and sand, and the like which are excavated by the cutter head 21.

The rear support 18 is provided on the main beam 14. The rear support 18 supports the main beam 14 when the rear body portion 12 moves forward.

The tunnel excavation device 1 includes a vehicle (not shown) which has a control device, a power supply device, a hydraulic system, and the like. The control device, the power supply device, the hydraulic system, and the like are used to operate the cutter head 21, the belt conveyor 17, the plurality of thrust cylinders 13*a*, the gripper portion 71, and the like.

(Front Body Portion)

As shown in FIG. 1, the front body portion 11 supports the cutter head 21. For example, the front body portion 11 includes the cutter head 21, a cutter head support 22, a vertical support 23, a pair of side supports 24, and a roof support 26.

The cutter head 21 is provided on a front portion of the front body portion 11. Specifically, the cutter head 21 is rotatably provided with respect to the cutter head support 22. The cutter head 21 includes a head main body 21*a*, a plurality of roller cutters 21*b*, and a plurality of scrapers 21*c*.

The plurality of roller cutters 21*b* are provided on a surface of the excavation side of the head main body 21*a*. The plurality of scrapers 21*c* take the excavated bedrock in the cutter head 21. The plurality of scrapers 21*c* are disposed on an outer peripheral portion of the head main body 21*a* at intervals from each other.

The cutter head support 22 is disposed in the rear of the cutter head 21. The cutter head support 22 rotatably supports the cutter head 21. Front end portions of the plurality of thrust cylinders 13*a* are connected to the cutter head support 22.

The vertical support 23, the pair of side supports 24 and the roof support 26 support the cutter head support 22 against the inner wall of the tunnel and slide on the inner wall of the tunnel during the excavation. The vertical support 23, the pair of side supports 24, and the roof support 26 are mounted to the cutter head support 22 so as to surround the cutter head support 22.

The vertical support 23, the pair of side supports 24, and the roof support 26 are respectively disposed below the cutter head support 22, on both sides of the cutter head support 22 in the width direction, and above the cutter head support 22.

The vertical support 23, the pair of side supports 24, and the roof support 26 are moved in a radial direction away from the cutter head support 22 and in the radial direction closer to the cutter head support 22 by a link mechanism and a hydraulic cylinder (not shown).

(Rear Body Portion)

Figure 2:
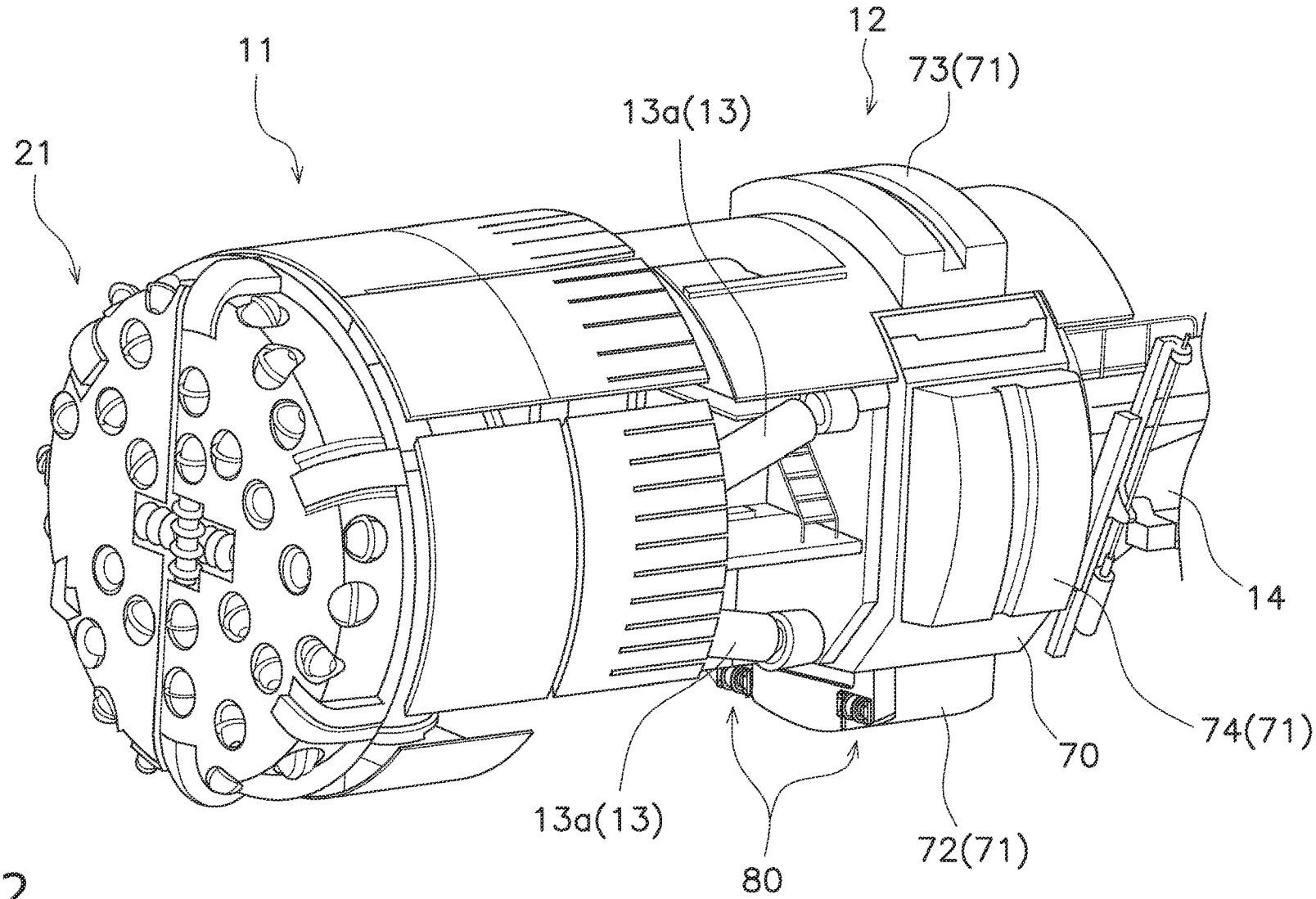
FIG. 2 is a perspective view showing a front body portion and a rear body portion of the tunnel excavation device of FIG. 1.
Figure 3:
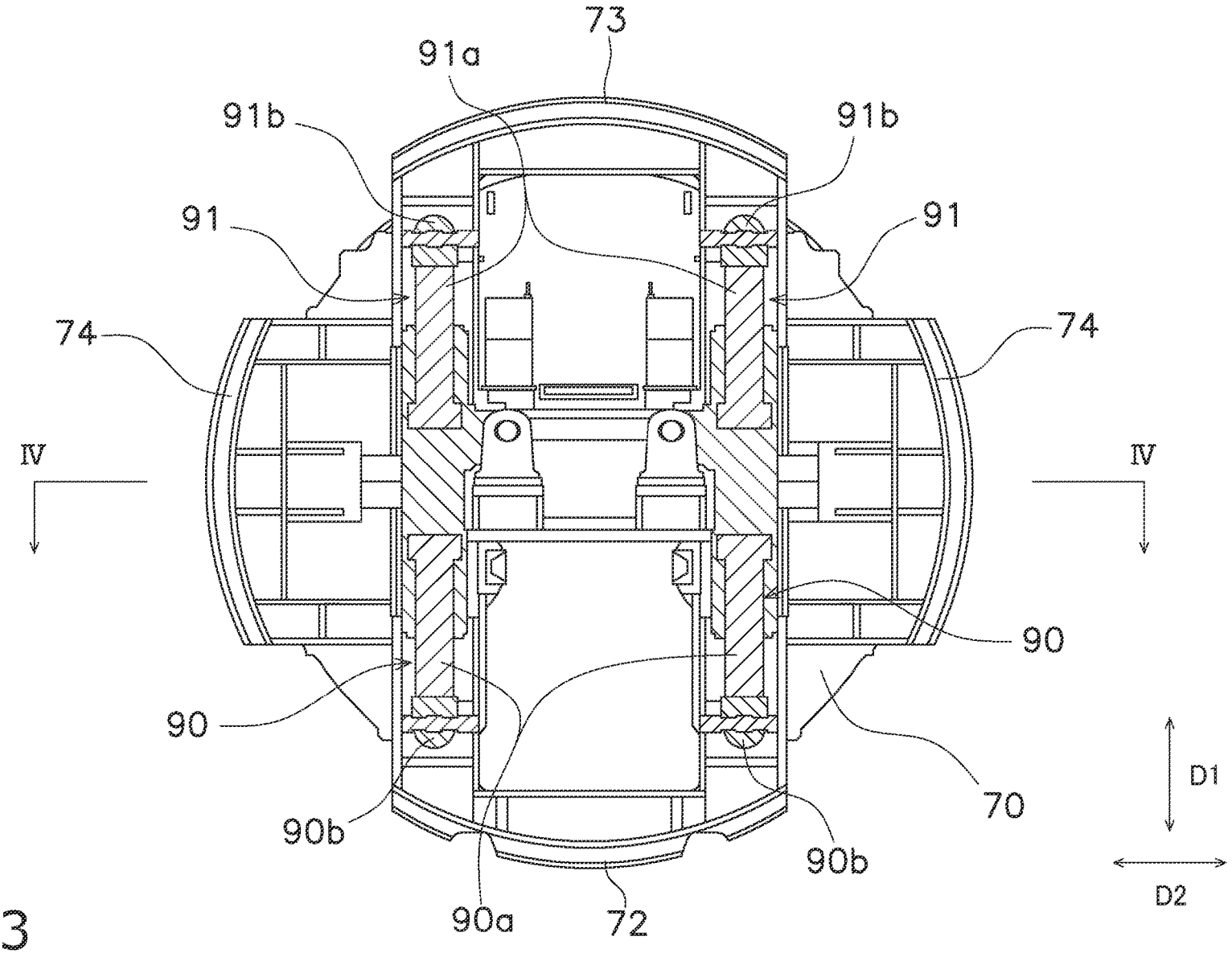
FIG. 3 is a vertical cross-sectional view of the rear body portion of FIG. 2.

As shown in FIGS. 2 and 3, the rear body portion 12 includes a gripper carrier 70 (an example of a rear main body), the gripper portion 71, and a wheel portion 80 for traveling. The rear body portion 12 further includes first to third hydraulic cylinders 90, 91, 92.

"Gripper Carrier"

As shown in FIG. 2, the gripper carrier 70 is disposed in the rear of the front body portion 11. For example, the gripper carrier 70 is disposed between the connecting portion 13 and the rear support 18 (see FIG. 1). The gripper carrier 70 is connected to rear ends of the plurality of thrust cylinders 13*a* of the connecting portion 13. The gripper carrier 70 is supported by the main beam 14. The gripper portion 71 is provided on the gripper carrier 70. For example, the gripper carrier 70 supports the gripper portion 71 via the first to third hydraulic cylinders 90, 91, 92.

"Gripper Portion"

As shown in FIG. 2, the gripper portion 71 is provided on the gripper carrier 70 to obtain a reaction force during the excavation. For example, the gripper portion 71 presses the inner wall of the tunnel during the excavation and supports the rear body portion 12 with respect to the inner wall of the tunnel. The gripper portion 71 is disposed on the gripper carrier 70 in a state where the gripper portion 71 protrudes outward from the gripper carrier 70.

As shown in FIGS. 2 and 3, the gripper portion 71 includes a bottom gripper 72 (an example of a first gripper) and an upper gripper 73 (an example of a second gripper). The gripper portion 71 further includes a pair of side grippers 74.

As shown in FIG. 3, the bottom gripper 72 is disposed below the gripper carrier 70. The bottom gripper 72 is supported by the gripper carrier 70 via the pair of first hydraulic cylinders 90. The pair of first hydraulic cylinders 90 are disposed parallel to each other. The pair of first hydraulic cylinders 90 are disposed along a vertical direction D1.

The upper gripper 73 is disposed above the gripper carrier 70. The upper gripper 73 is supported by the gripper carrier 70 via the pair of second hydraulic cylinders 91. The pair of second hydraulic cylinders 91 are disposed parallel to each other. The pair of second hydraulic cylinders 91 are disposed above the pair of first hydraulic cylinders 90 along the vertical direction D1.

Figure 4:
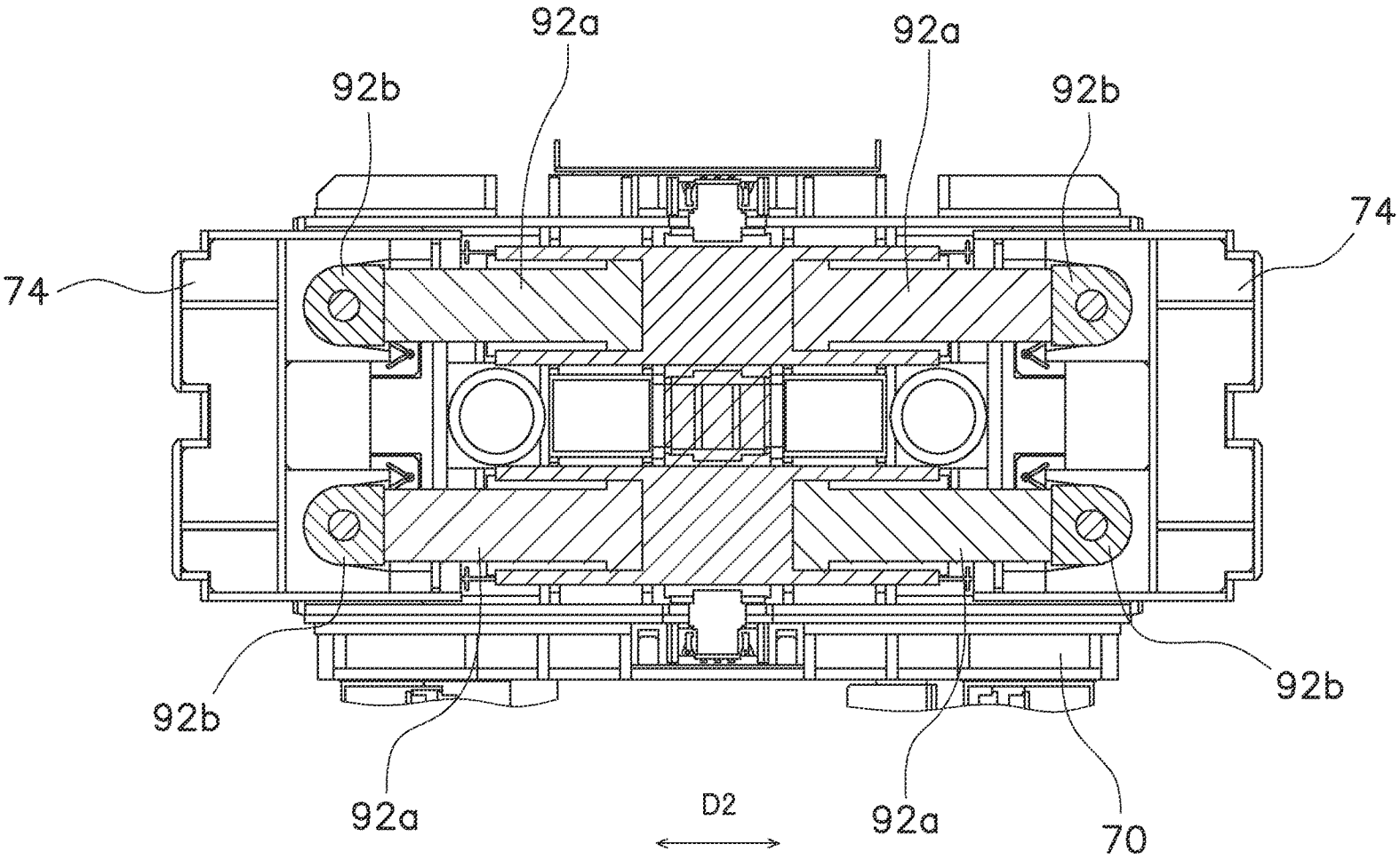
FIG. 4 is a cross-sectional view which is cut along a cutting line IV of FIG. 3.

As shown in FIG. 4, the pair of side grippers 74 are disposed on both sides of the gripper carrier 70 in a width direction D2. Each of the pair of side grippers 74 is supported by the gripper carrier 70 via the pair of third hydraulic cylinders 92. The pair of third hydraulic cylinders 92 are disposed parallel to each other. The pair of third hydraulic cylinders 92 are disposed along the width direction D2.

As shown in FIGS. 3 and 4, each of the first hydraulic cylinders 90, each of the second hydraulic cylinders 91, and each of the third hydraulic cylinders 92 respectively include rods 90*b*, 91*b*, 92*b*. The rods 90*b*, 91*b*, 92*b* are connected respectively to pistons which are disposed respectively in cylinders 90*a*, 91*a*, 92*a*. Ends of the cylinders 90*a*, 91*a*, 92*a* are mounted to the gripper carrier 70.

The end of the cylinder 90*a* of each of the first hydraulic cylinders 90, the end of the cylinder 91*a* of each of second hydraulic cylinders 91, and the end of the cylinder 92*a* of each of the third hydraulic cylinders 92 are mounted to the gripper carrier 70. The end of the rod 90*b* of each of first hydraulic cylinders 90 is mounted to the bottom gripper 72. The end of the rod 91*b* of each of the second hydraulic cylinders 91 is mounted to the upper gripper 73. The end of the rod 92*b* of each of the third hydraulic cylinders 92 is mounted to the side gripper 74.

The bottom gripper 72 moves in a direction away from the gripper carrier 70 or in a direction closer to the gripper carrier 70 by extending and contracting the pair of first hydraulic cylinders 90, for example, advancing and retreating the rods 90*b* with respect to the cylinders 90*a*.

The upper gripper 73 moves in a direction away from the gripper carrier 70 or in a direction closer to the gripper carrier 70 by extending and contracting the pair of second hydraulic cylinders 91, for example, advancing and retreating the rods 91*b* with respect to the cylinders 91*a*.

Each of the side grippers 74 moves in a direction away from the gripper carrier 70 or in a direction closer to the gripper carrier 70 by extending and contracting the pair of third hydraulic cylinders 92, for example, advancing and retreating the rods 92*b* with respect to the cylinders 92*a*.

Figure 5:
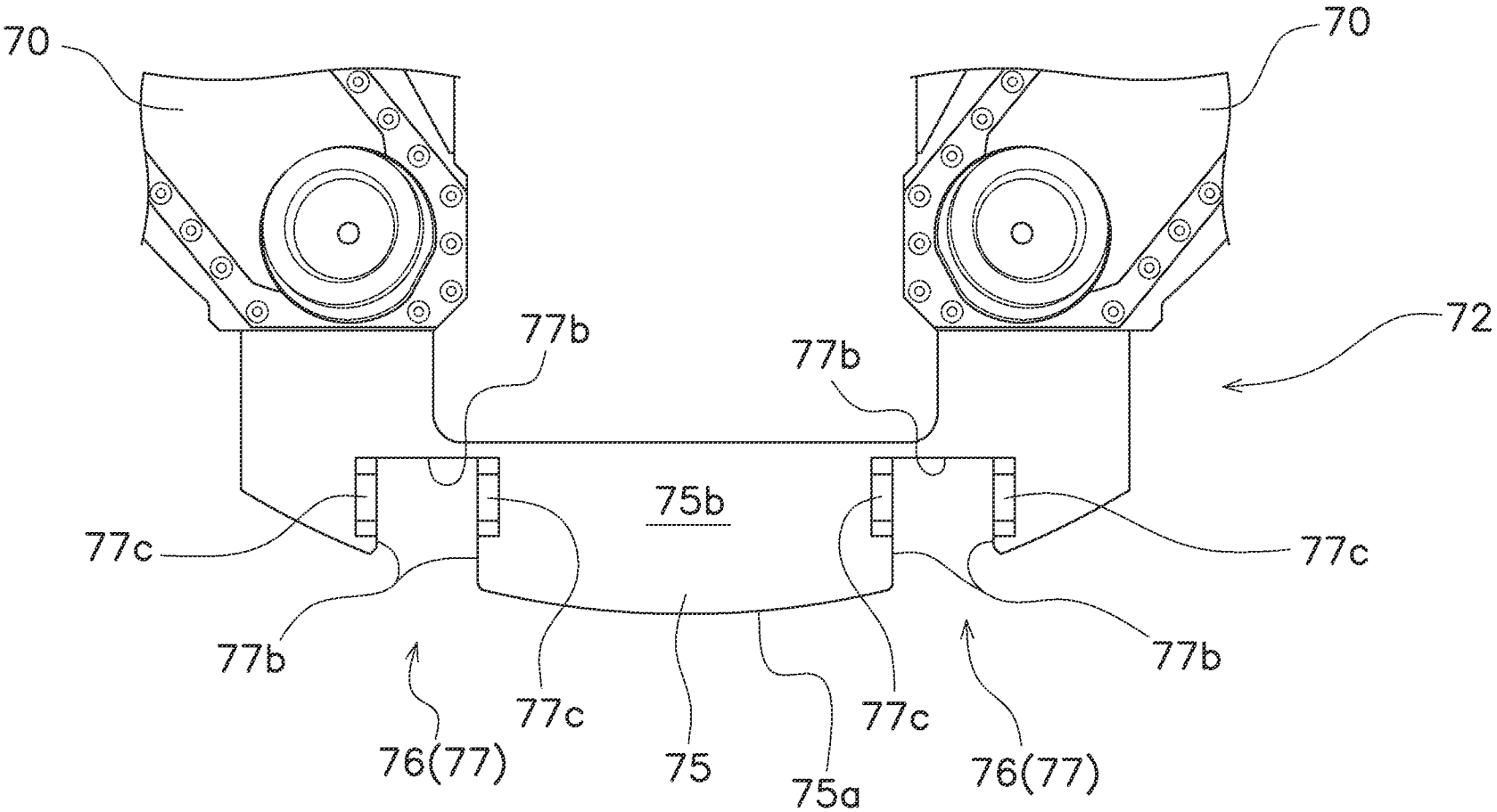
FIG. 5 is a front view of a bottom gripper on the rear body portion.

The bottom gripper 72 of the gripper portion 71 of the above configuration further includes the following configuration. As shown in FIG. 5, the bottom gripper 72 includes a groove portion 76. For example, the bottom gripper 72 includes a gripper main body 75 and the groove portion 76.

The gripper main body 75 includes an outer peripheral surface 75*a* which is formed in a substantially arc shape. The outer peripheral surface 75*a* of the gripper main body 75 contacts the inner wall of the tunnel. Specifically, the outer peripheral surface 75*a* of the gripper main body 75 contacts a lower inner wall of the tunnel.

The groove portion 76 is provided on the gripper main body 75. For example, the groove portion 76 is provided in a lower portion of the gripper main body 75 in a state where the bottom gripper 72 is supported by the gripper carrier 70. The groove portion 76 is formed in a recess shape toward the gripper carrier 70. For example, the groove portion 76 is formed by being recessed from the outer peripheral surface 75*a* of the gripper main body 75.

Figure 6:
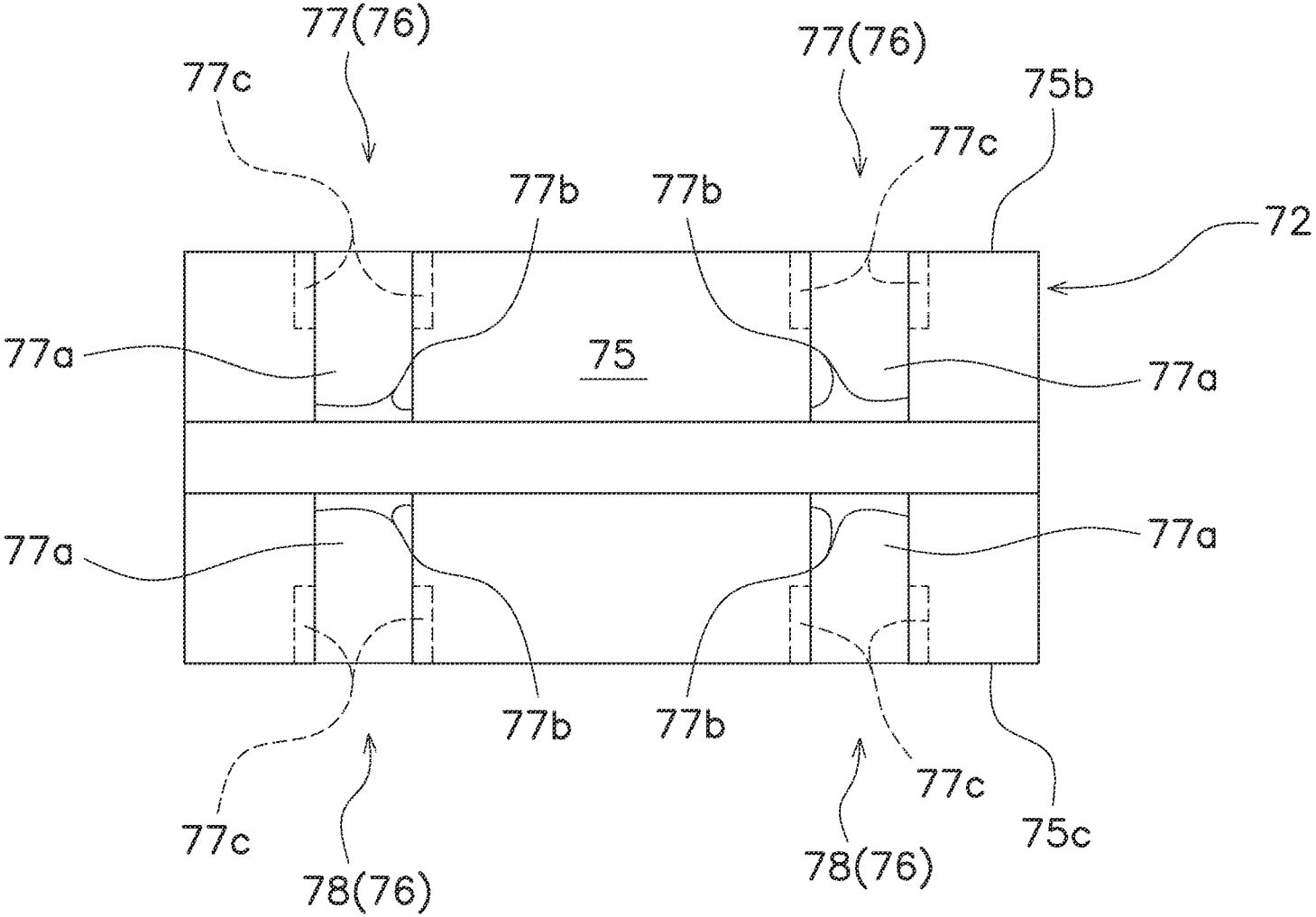
FIG. 6 is a bottom view of a bottom gripper on the rear body portion.

As shown in FIG. 6, the groove portion 76 includes a pair of first groove portions 77 and a pair of second groove portions 78. The pair of first groove portions 77 extend rearward from the front portion 75*b* of the gripper main body 75. The pair of first groove portions 77 are provided on the gripper main body 75 so as to be parallel to each other. The pair of second groove portions 78 extend forward from the rear portion 75*c* of the gripper main body 75. The pair of second groove portions 78 are provided on the gripper main body 75 so as to be parallel to each other.

As shown in FIGS. 5 and 6, each of the pair of first groove portions 77 and each of the pair of second groove portions 78 respectively include a bottom surface 77*a*, a pair of side walls 77*b*, and a pair of engagement grooves 77*c* (an example of a pair of engagement grooves).

The bottom surface 77*a* is provided on the gripper main body 75. For example, the bottom surface 77*a* is formed on the gripper main body 75 so as to face the lower inner wall of the tunnel in a state where the bottom gripper 72 is supported by the gripper carrier 70.

As shown in FIG. 5, the pair of side walls 77*b* are provided on the gripper main body 75 so as to face each other. For example, the pair of side walls 77*b* extend from the bottom surface 77*a* toward the outer peripheral surface 75*a* of the gripper main body 75.

The pair of engagement grooves 77*c* are respectively provided on the pair of side walls 77*b*. Each of the pair of engagement grooves 77*c* is formed by being recessed from each of the pair of side walls 77*b*. Each of a pair of protruding portions 85 (described later) of the wheel portion 80 is disposed in each of the pair of engagement grooves 77*c*.

As shown in FIG. 6, the pair of engagement grooves 77*c*, which are provided in each of the pair of first groove portions 77, extend rearward from the front portion 75*b* of the gripper main body 75. The pair of engagement grooves 77*c*, which are provided in each of the pair of first groove portions 77, are respectively provided on the pair of side walls 77*b* of the pair of first groove portions 77 so as to face each other.

The pair of engagement grooves 77*c*, which are provided in each of the pair of second groove portions 78, extend forward from the rear portion 75*c* of the gripper main body 75. The pair of engagement grooves 77*c*, which are provided in each of the pair of second groove portions 78, are respectively provided on the pair of side walls 77*b* of the pair of second groove portions 78 so as to face each other.

"Wheel portion"

Figure 7:
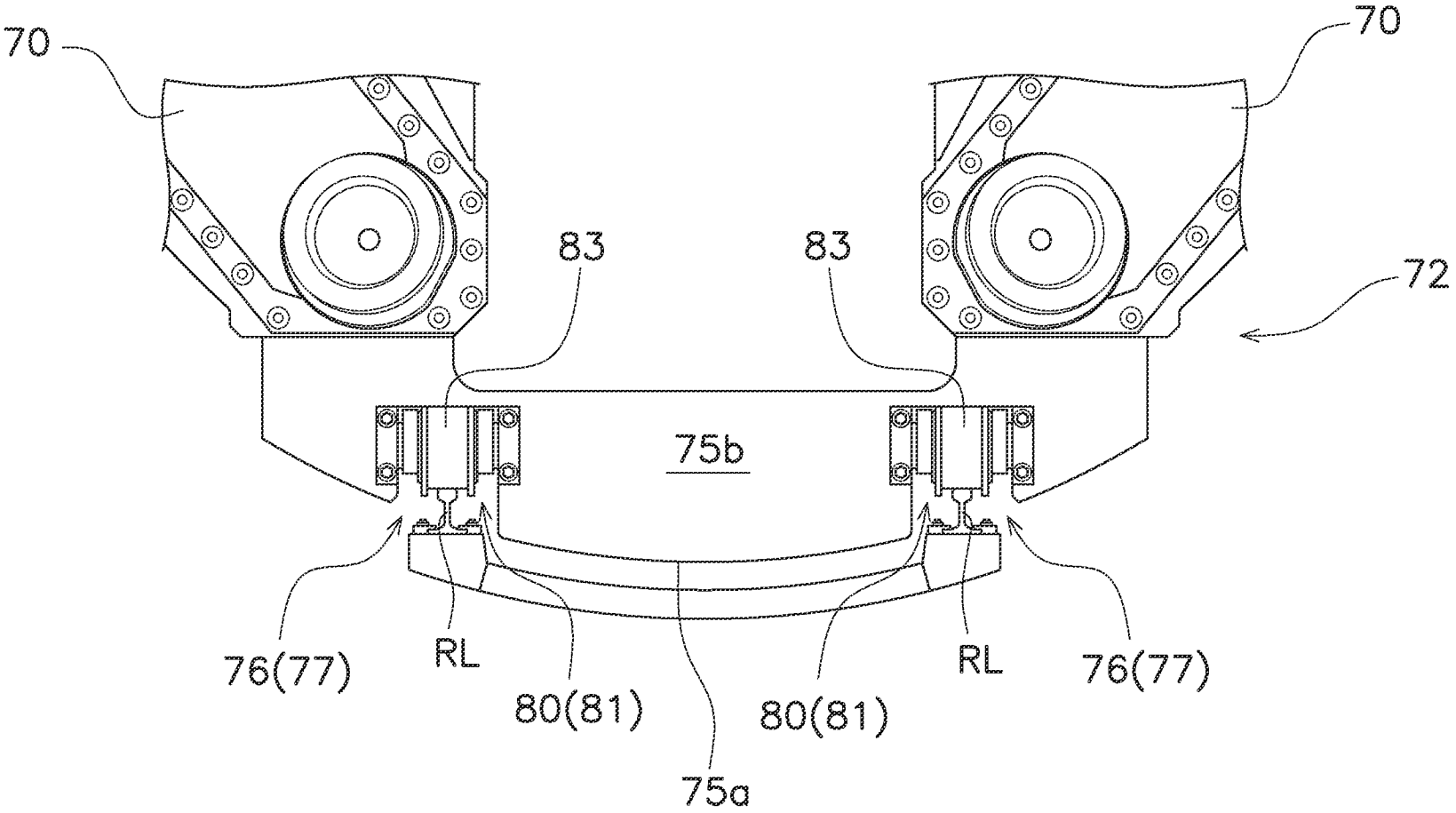
FIG. 7 is a front view in which a wheel portion is disposed on the bottom gripper of FIG. 5.
Figure 8:
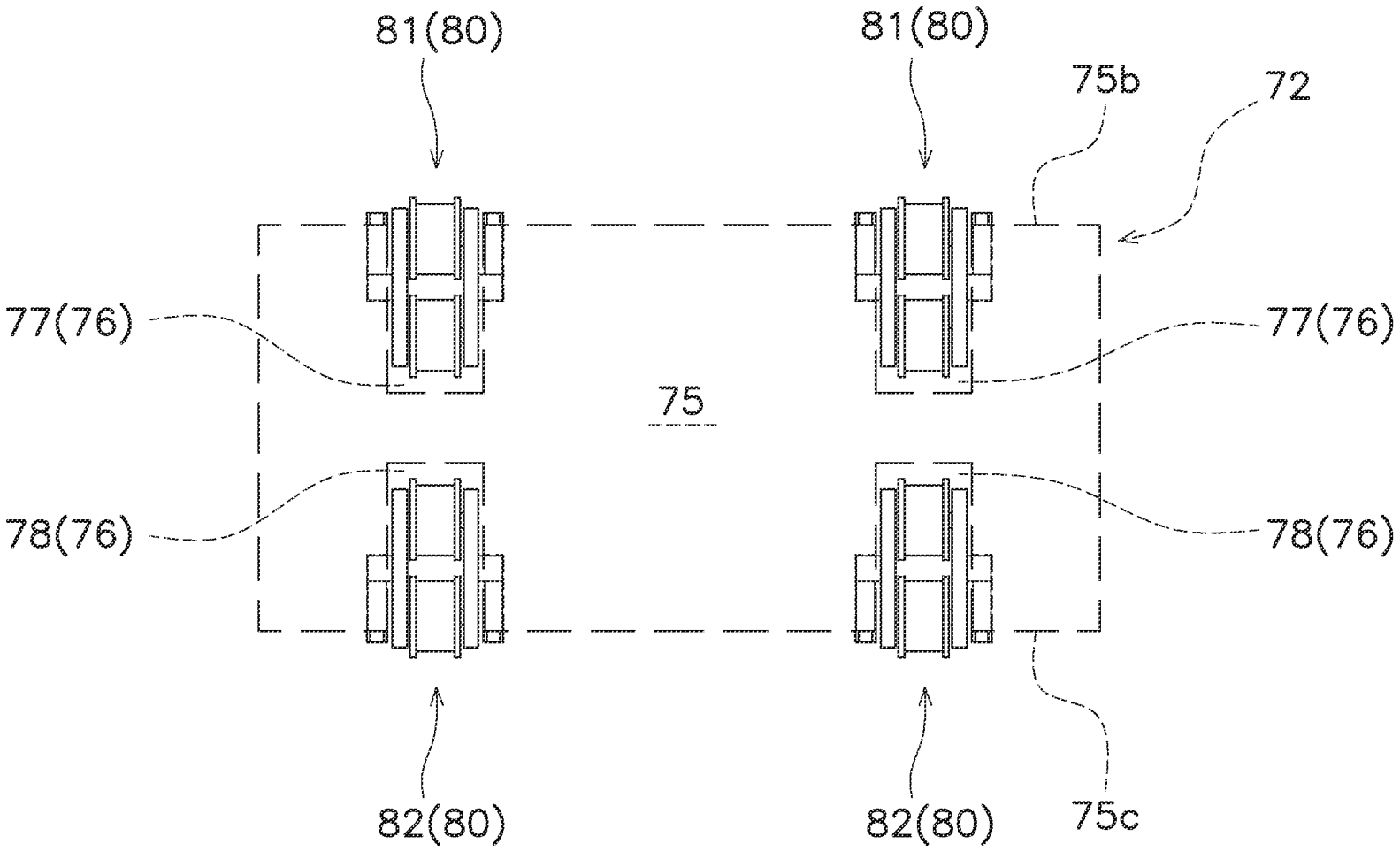
FIG. 8 is a bottom view in which the wheel portion is disposed on the bottom gripper of FIG. 6.

As shown in FIGS. 7 and 8, the wheel portion 80 is disposed in the groove portion 76. The wheel portion 80 includes a pair of first wheel portions 81 and a pair of second wheel portions 82 (see FIG. 8).

Each of the pair of first wheel portions 81 is disposed in each of the pair of first groove portion 77. Each of the pair of first wheel portions 81 is disposed inside the outer peripheral surface 75*a* of the gripper main body 75 (see FIG. 7). In other words, each of the pair of first wheel portions 81 is disposed inside the outer peripheral surface 75*a* of the gripper main body 75 in a state where each of the pair of first wheel portions 81 is disposed in each of the pair of first groove portions 77. Each of the pair of first wheel portions 81 is detachably mounted to each of the pair of first groove portions 77 from the front portion 75*b* of the gripper main body 75 of the bottom gripper 72 (see FIG. 8).

Each of the pair of second wheel portions 82 is disposed in each of the pair of second groove portions 78. Each of the pair of second wheel portions 82 is disposed inside the outer peripheral surface 75*a* of the gripper main body 75 (see FIG. 7). In other words, each of the pair of second wheel portions 82 is disposed inside the outer peripheral surface 75*a* of the gripper main body 75 in a state where each of the pair of second wheel portions 82 is disposed in each of the pair of second groove portions 78. Each of the pair of second wheel portion 82 is detachably mounted to each of the pair of second groove portions 78 from the rear portion 75*c* of the gripper main body 75 of the bottom gripper 72 (see FIG. 8).

Figure 9:
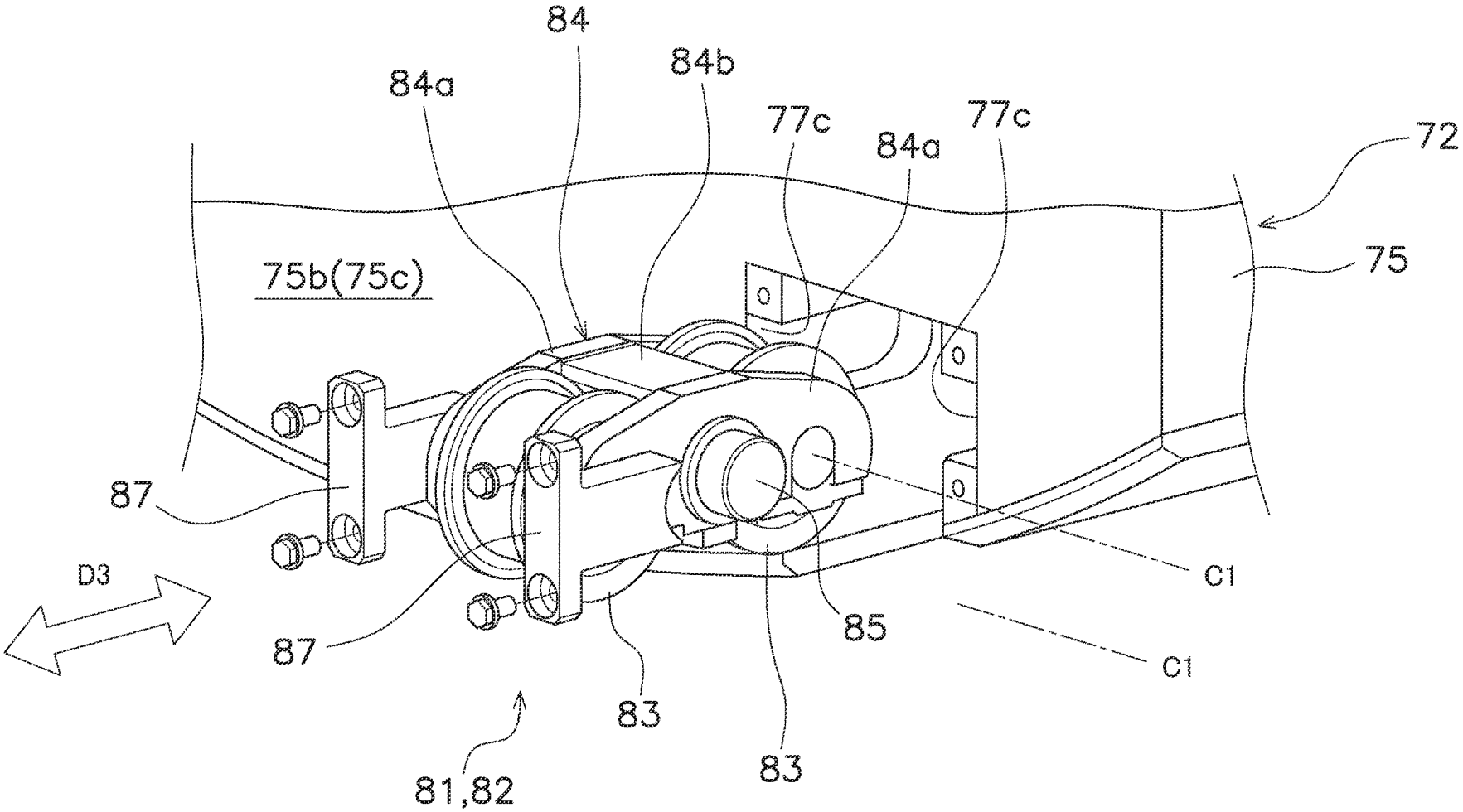
FIG. 9 is a perspective view of the wheel portion.
Figure 10:
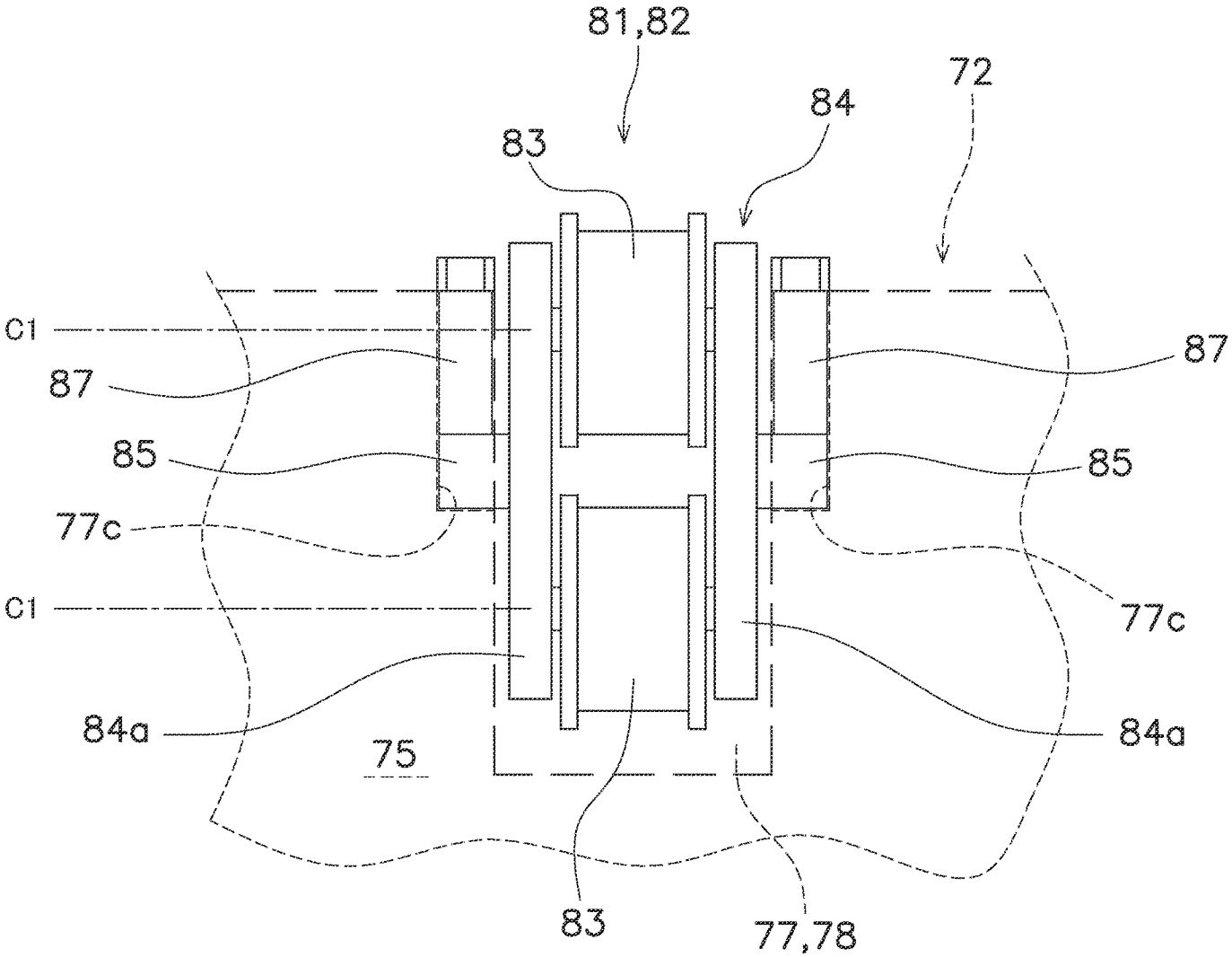
FIG. 10 is an enlarged view of the wheel portion which is disposed on the bottom gripper.

As shown in FIGS. 9 and 10, each of the pair of first wheel portions 81 and each of the pair of second wheel portions 82 respectively include a pair of wheels 83, a carrier 84, and the pair of protruding portions 85. The pair of wheels 83 are disposed on rails RL (see FIG. 7). The pair of wheels 83 are rotatably mounted on the carrier 84.

The carrier 84 rotatably holds the pair of wheels 83. The carrier 84 includes a pair of holding plates 84*a* and a connecting portion 84*b*. The pair of holding plates 84*a* are disposed at an interval from each other. The connecting portion 84*b* connects a pair of holding plates 84*a*. For example, the connecting portion 84*b* is integrally formed with the pair of holding plates 84*a*.

The pair of wheels 83 are disposed between the pair of holding plates 84*a*. For example, each of the pair of wheels 83 is rotatably disposed around each of shaft portions which are fixed to the pair of holding plates 84*a*.

The pair of protruding portions 85 are respectively provided on the pair of holding plates 84*a*. Each of the pair of protruding portions 85 protrudes from the carrier 84. For example, each of the pair of protruding portions 85 protrudes outward from each of the pair of holding plates 84*a* in a direction. The direction is parallel to a direction in which a rotation axis C1 of each of the pair of wheels 83 extends.

The pair of protruding portions 85 of each of the pair of first wheel portions 81 engage the pair of engagement grooves 77*c* in each of the pair of first groove portion 77. For example, the pair of protruding portions 85 of each of the pair of first wheel portions 81 are inserted into the pair of engagement grooves 77*c* from the front portion 75*b* of the gripper main body 75 (see FIG. 10). In this state, a retaining member 87 is mounted to the front portion 75*b* of the gripper main body 75. Thereby, it is possible to restrict pulling-out of each of the pair of first wheel portions 81 from the gripper main body 75. Also, each of the pair of first wheel portions 81 can be removed from the gripper main body 75 by removing the retaining member 87 from the gripper main body 75.

The pair of protruding portions 85 of each of the pair of second wheel portions 82 engage the pair of engagement grooves 77*c* in each of the pair of second groove portions 78. For example, the pair of protruding portions 85 of each of the pair of second wheel portions 82 are inserted from the rear portion 75*c* of the gripper main body 75 into the pair of engagement grooves 77*c* (see FIG. 10). In this state, the retaining member 87 is mounted to the rear surface of the gripper main body 75. Thereby, it is possible to restrict pulling-out of each of the pair of second wheel portions 82 from the gripper main body 75. Also, each of the pair of second wheel portions 82 can be removed from the gripper main body 75 by removing the retaining member 87 from the gripper main body 75, In this way, the wheels 83 of each of the pair of first wheel portions 81 and the wheels 83 of each of the pair of second wheel portions 82 can be disposed on the rails RL by mounting the pair of the first wheel portions 81 and the pair of the second wheel portions 82 on the gripper main body 75.

<Operation of Tunnel Excavation Device>

Firstly, in the tunnel excavation device 1 of the present embodiment includes the bottom gripper 72, the upper gripper 73, and the pair of side grippers 74 press against the inner wall of the tunnel by protruding the bottom gripper 72, the upper gripper 73, and the pair of side grippers 74 from the gripper carrier 70. Thereby, the rear body portion 12 is supported by the inner wall of the tunnel.

In this state, the front body portion 11 moves forward with respect to the rear body portion 12 by extending the thrust cylinders 13*a*. Thereby, the cutter head 21 is brought into contact with the bedrock and the excavation of the bedrock is performed by the cutter head 21.

At this time, the vertical support 23, the bedrock is stably excavated by sliding the pair of side supports 24, and the roof support 26 on the inner wall of the tunnel.

Secondly, the rear body portion 12 moves forward by contracting the thrust cylinders 13*a* while the main beam 14 is supported upward by the rear support 18. The tunnel excavation device 1 moves forward while excavating by repeating this operation.

A pair of retreating hydraulic cylinders (not shown) can be mounted to the front portion 75*b* of the bottom gripper 72 (gripper main body 75). The pair of retracting hydraulic cylinders are disposed between the bottom gripper 72 and the pair of rails RL and connect the bottom gripper 72 and the pair of rails RL. The tunnel excavation device 1 can be retracted by expanding and contracting the pair of retractable hydraulic cylinders.

An excavating process of the tunnel will be described with the tunnel excavation device 1.

Figure 11A:
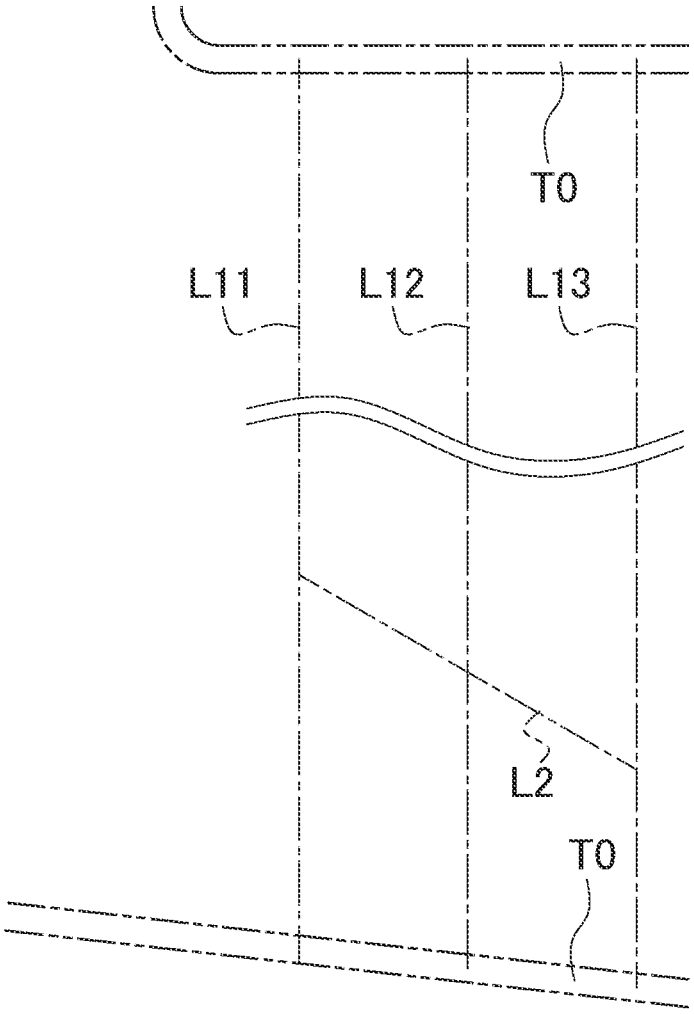
FIG. 11A is a diagram showing step S1 of a tunnel excavation process.

Firstly, as shown in FIG. 11A, the excavation lines L11, L12 and L13 are set in order to excavate three first tunnels T11, T12, T13 (see FIG. 11F), which is substantially parallel to each other, from an existing two tunnels T0, in step S1. Also, a second excavation line L2 is set in order to excavate a second tunnel T2 (see FIG. 11H) which intersects the three first tunnels T11, T12, T13.

Figure 11B:
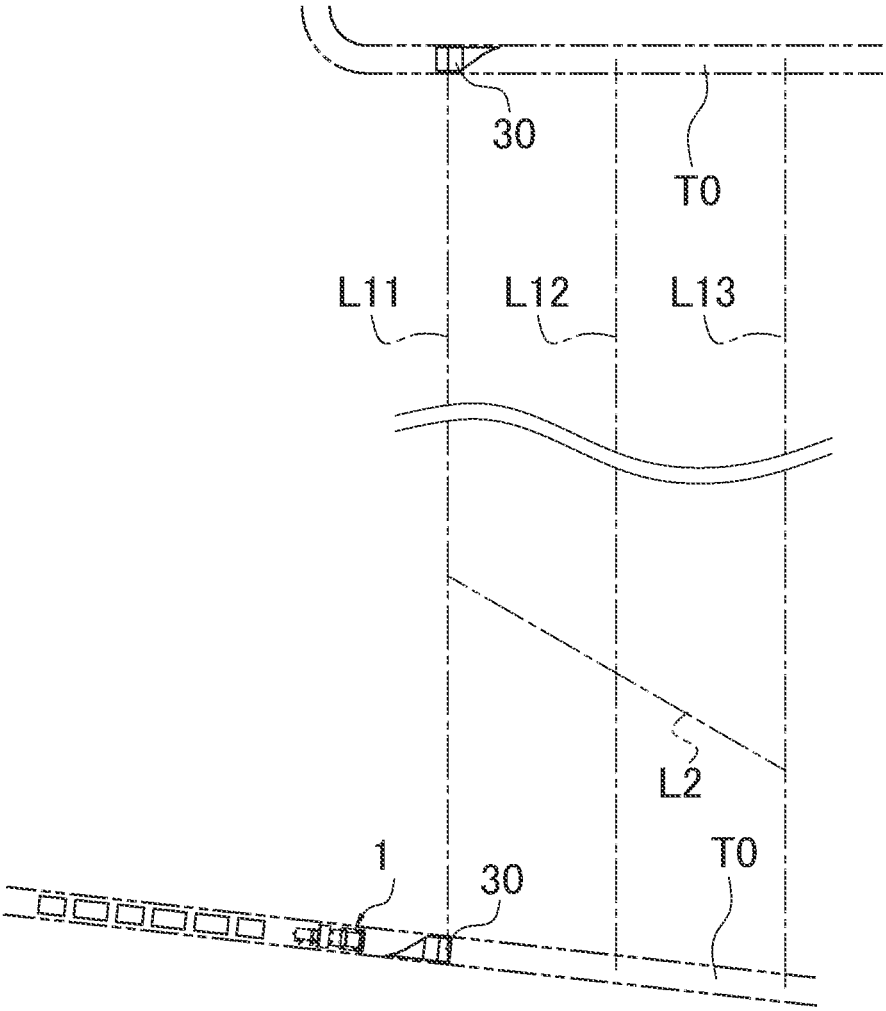
FIG. 11B is a diagram showing step S2 of the tunnel excavation process.

Subsequently, as shown in FIG. 11B, the tunnel excavation device 1 moves to a vicinity of an intersection position of the existing tunnel TO and the first excavation line L11, in order to branch the existing tunnel TO toward the first excavation line L11, in step S2. For example, the tunnel excavation device 1 is towed by a tow tractor and is disposed at the vicinity of the intersection position.

At this time, a reaction force receiving portion 30 for a corner is installed at the intersection position. Thereby, the tunnel excavation device 1 can start the excavation of the first tunnel T11, while contacting the gripper portion 71 (side gripper 74) with the reaction force receiving portion 30 in a bent portion which branches from the existing tunnel T0 to the first tunnel T11.

Figure 11C:
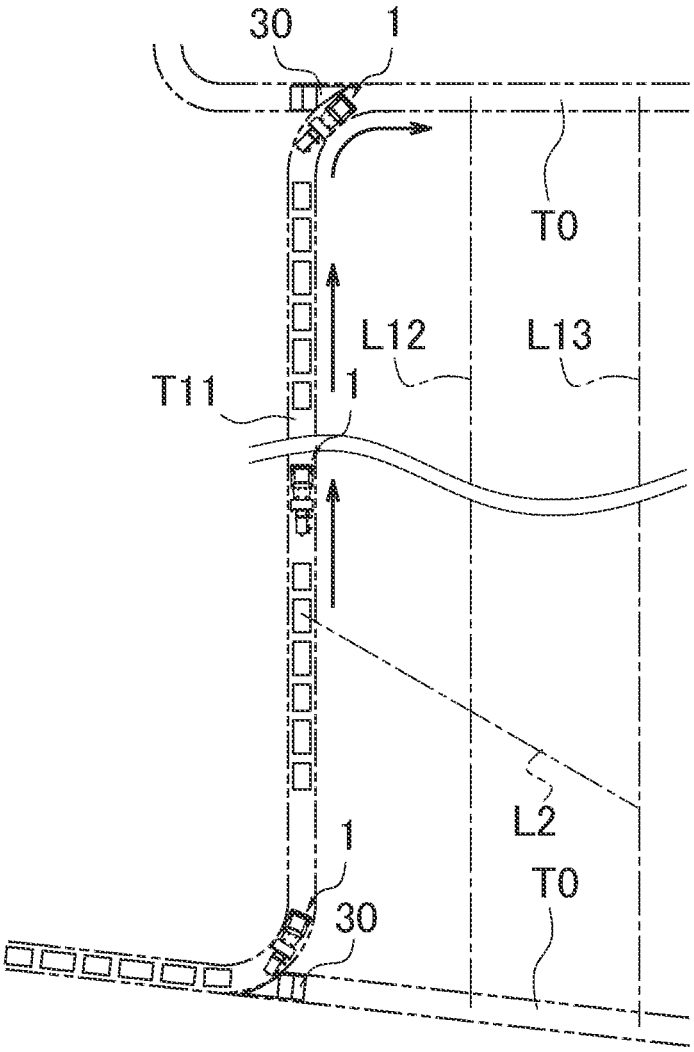
FIG. 11C is a diagram showing step S3 of the tunnel excavation process.

Subsequently, as shown in FIG. 11C, the tunnel excavation device 1 excavates the bedrock along the first excavation line L11 in step S3. Thereby, the first tunnel T11 is formed at a position of the first excavation line L11.

The reaction force receiving portion 30 is disposed at the intersection position at which an end of the first tunnel T11 is connected to the existing tunnel TO (see FIGS. 11B and 11C).

Figure 11D:
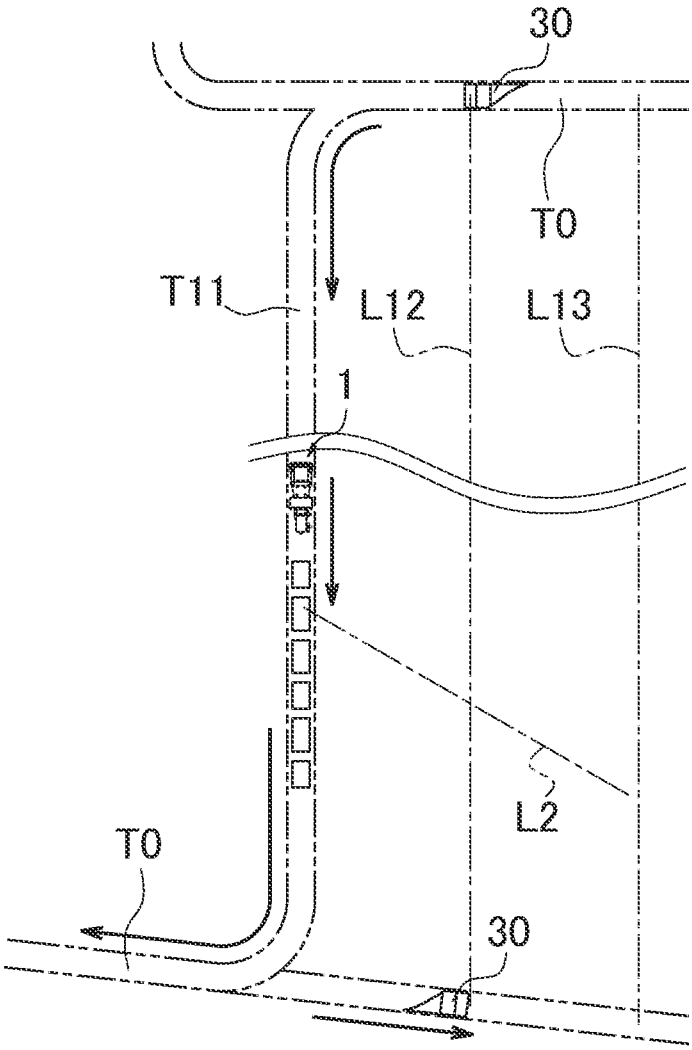
FIG. 11D is a diagram showing step S4 of the tunnel excavation process.

Subsequently, as shown in FIG. 11D, the tunnel excavation device 1 retreats to an excavation start position (a position shown in FIG. 11B) of the first tunnel T11 in step S4.

Figure 11E:
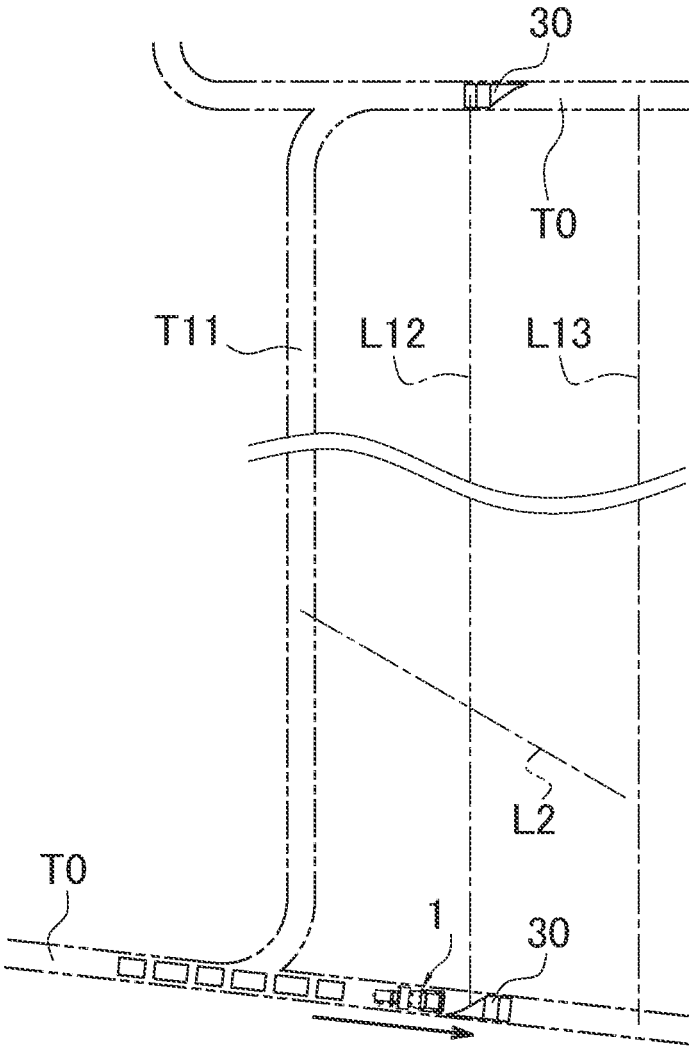
FIG. 11E is a diagram showing step S5 of the tunnel excavation process.

Subsequently, as shown in FIG. 11E, the tunnel excavation device 1 moves to a vicinity of an intersection position of the existing tunnel TO and the first excavation line L12, in order to branch the existing tunnel TO toward the first excavation line L12, in step S5. For example, the tunnel excavation device 1 is towed by the tow tractor and is disposed at the vicinity of the intersection position.

Figure 11F:
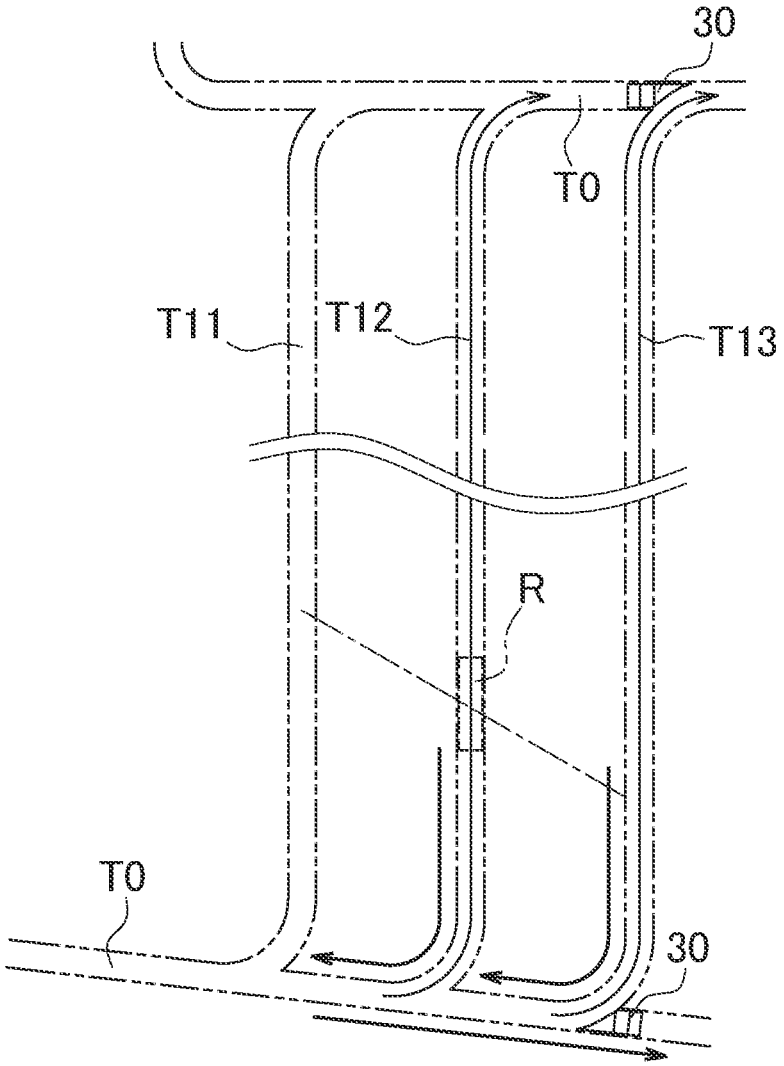
FIG. 11F is a diagram showing step S6 of the tunnel excavation process.

Subsequently, as shown in FIG. 11F, the tunnel excavation device 1 excavates the bedrock along the first excavation line L12 by the same process as in step S3, in step S6. Thereby, the first tunnel T12 is formed at a position of the first excavation line L12. After an excavation of the first tunnel T12, the tunnel excavation device 1 retreats to an excavation start position (a position shown in FIG. 11E) of the first tunnel T12.

A reinforcing agent for reinforcing an inner wall of the first tunnel T12 is coated on the inner wall of the first tunnel T12 which includes an intersection position of the first excavation line L12 and the second excavation line L2.

Preferably, a predetermined reinforcement range R of upper and lower inner walls in the first tunnel T12 is reinforced by the reinforcing agent.

In this case, preferably, the reinforcement range R of the upper inner wall of the first tunnel T12 is equal to or larger than a range in which the upper gripper 73 contacts the upper inner wall of the first tunnel T12. Preferably, the reinforcement range R of the lower inner wall of the first tunnel T12 is equal to or larger than a range in which the bottom gripper 72 contacts the lower inner wall of the first tunnel T12. Also, preferably, the reinforcement range R of the upper inner wall of the first tunnel T12 and the reinforcement range R of the lower inner wall of the first tunnel T12 are equal to or larger than a diameter of the second tunnel T2.

After that, in the same process as the first tunnel T12 described above, the tunnel excavation device 1 excavates the bedrock along the first excavation line L13. Thereby, the first tunnel T13 is formed at a position of the first excavation line L13. After an excavation of the first tunnel T13, the tunnel excavation device 1 retreats to an excavation start position of the first tunnel T13.

Figure 11G:
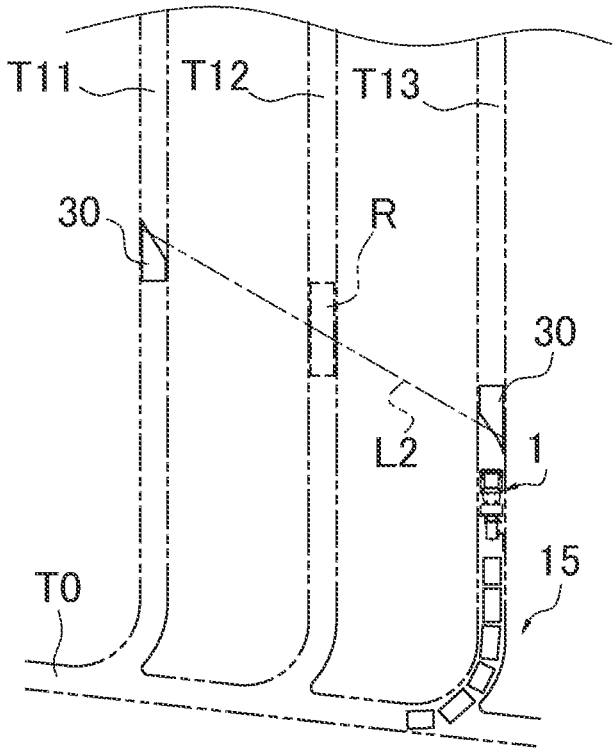
FIG. 11G is a diagram showing step S7 of the tunnel excavation process.

Secondly, as shown in FIG. 11G, the tunnel excavation device 1 moves to a vicinity of an intersection position of the first tunnel T13 and the second excavation line L2, in order to branch the existing first tunnel T13 toward the second excavation line L2, in step S7. For example, the tunnel excavation device 1 is towed by the tow tractor and is disposed at the vicinity of the intersection position.

Figure 11H:
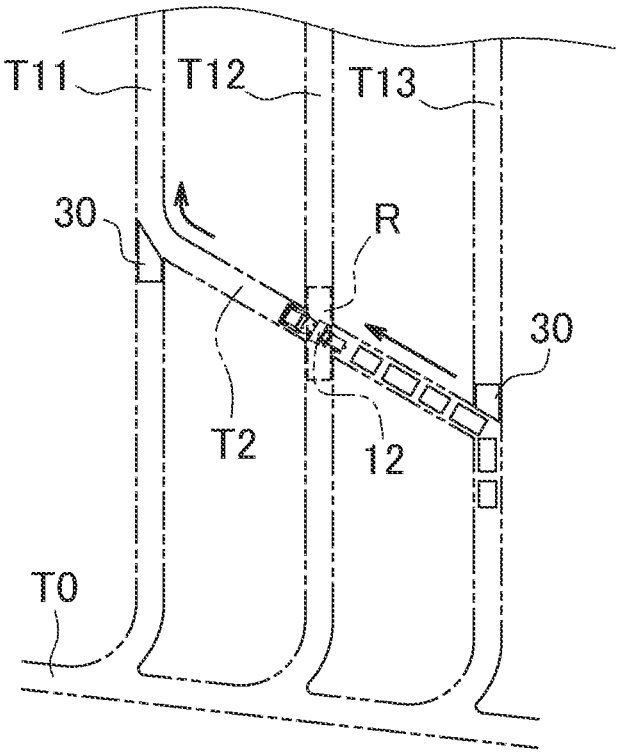
FIG. 11H is a diagram showing step S8 of the tunnel excavation process.

Subsequently, as shown in FIG. 11H, the tunnel excavation device 1 changes a course from the first tunnel T13 to the second excavation line L2 by using the reaction force receiving portion 30, in step S8. Thereby, the tunnel excavation device 1 excavates the bedrock along the second excavation line L2.

When the rear body portion 12 of the tunnel excavation device 1 reaches the first tunnel T12, the pair of side grippers 74 of the rear body portion 12 cannot receive the reaction force from the inner walls of the first tunnel T12 and the second tunnel T2 at an intersection portion of the first tunnel T12 and the second tunnel T2, Thus, the tunnel excavation device 1 receives the reaction force from the inner wall of the intersection portion of the first tunnel T12 and the second tunnel T2 at the intersection portion of the first tunnel T12 and the second tunnel T2 by using the bottom gripper 72 and the upper gripper 73. Thereby, the tunnel excavation device 1 can continue the excavation of the bedrock along the second excavation line L2.

Then, after the rear body portion 12 of the tunnel excavation device 1 passes through the intersection portion of the first tunnel T12 and the second tunnel T2, the pair of side grippers 74 of the rear body portion 12 can receive the reaction force from the inner wall of the second tunnel T2 which is excavated by the cutter head 21 of the front body portion 11.

Thus, after the rear body portion 12 passes through the intersection portion of the first tunnel T12 and the second tunnel T2, the tunnel excavation device 1 excavates the bedrock along the second excavation line L2 by using the bottom gripper 72, the upper gripper 73, and the pair of side grippers 74. Subsequently, the second tunnel T2 intersecting the first tunnels T11, T12, T13 is formed when the tunnel excavation device 1 reaches the first tunnel T11.

In the tunnel excavation device 1 including the above configuration, the wheel portion 80 (the first wheel portion 81 and the second wheel portion 82) is disposed in the groove portion 76 (the first groove portion 77 and the second groove portion 78) of the bottom gripper 72. Thereby, even if the wheel portions 80 (the first wheel portion 81 and the second wheel portion 82) is provided on the tunnel excavation device 1, the tunnel excavation device 1 can reduce a radial dimension.

Also, in the tunnel excavation device 1, the bottom gripper 72 is disposed inside the outer peripheral surface 75*a* of the gripper main body 75, in the state where the wheel portion 80 (the first wheel portion 81 and the second wheel portion 82) is disposed in the groove portion 76 (the first groove portion 77 and the second groove portion 78). Thereby, the contact of the wheel portions 80 (the first wheel portion 81 and the second wheel portion 82) with the inner wall of the tunnel can be suppressed in a state where the outer peripheral surface 75*a* of the gripper main body 75 presses the inner wall of the tunnel.

Also, in the tunnel excavation device 1, the first wheel portion 81 is detachably mounted to the first groove portion 77 from the front portion 75*b* of the gripper main body 75 of the bottom gripper 72. In this case, the first wheel portion 81 can be easily mounted to the first groove portion 77 from the front portion 75*b* of the gripper main body 75. The first wheel portion 81 can be easily removed from the first groove portion 77. Thereby, the first wheel portion 81 can be easily maintained.

Also, in the tunnel excavation device 1, the second wheel portion 82 is detachably mounted to the second groove portion 78 from the rear portion 75*c* of the gripper main body 75 of the bottom gripper 72. In this case, the second wheel portion 82 can be easily mounted from the rear portion 75*c* of the gripper main body 75 to the second groove portion 78. The second wheel portion 82 can be easily removed from the second groove portion 78. Thereby, the second wheel portion 82 can be easily maintained.

Further, in the tunnel excavation device 1, the pair of protruding portions 85 of the wheel portion 80 (the first wheel portion 81 and the second wheel portion 82) engages with the pair of engagement grooves 77*c* of the groove portion 76 (the first groove portion 77 and the second groove portion 78) of the bottom gripper 72. Thereby, the wheel portion 80 (the first wheel portion 81 and the second wheel portion 82) can be easily disposed in the groove portion 76 (the first groove portion 77 and the second groove portion 78) of the bottom gripper 72.

A tunnel excavation device of the present disclosure can reduce a radial dimension.

What is claimed is:

1. A tunnel excavation device comprising:

a front body portion configured to support a cutter head; and a rear body portion movable relative to the front body portion, the rear body portion including a rear main body disposed in a rear of the front body portion, and a gripper portion provided on the rear main body to obtain a reaction force during excavation, the gripper portion including a groove portion formed in a recess shape toward the rear main body, and a wheel portion disposed in the groove portion, the wheel portion being moveable with the rear main portion relative to the front body portion.

2. The tunnel excavation device according to claim 1, wherein the gripper portion further includes a gripper main body;

the groove portion is formed by being recessed from an outer peripheral surface of the gripper main body; and the wheel portion is disposed inside the outer peripheral surface of the gripper main body in a state where the wheel portion is disposed in the groove portion.

3. The tunnel excavation device according to claim 2, wherein the groove portion includes a first groove portion extending rearward from a front portion of the gripper main body; and the wheel portion includes a first wheel portion mounted detachably to the first groove portion from the front portion of the gripper main body.

4. The tunnel excavation device according to claim 3, wherein the groove portion includes a second groove portion extending forward from a rear portion of the gripper main body; and the wheel portion includes a second wheel portion mounted detachably to the second groove portion from the rear portion of the gripper main body.

5. The tunnel excavation device according to claim 4, wherein the wheel portion includes a wheel, a carrier rotatably holding the wheel, and a pair of protrusions protruding from the carrier;

the pair of protrusions engage with a pair of engagement grooves; and the pair of engagement grooves are respectively provided on a pair of side walls of the groove portion.

6. The tunnel excavation device according to claim 5, wherein the gripper portion includes a first gripper disposed below the rear main body and a second gripper disposed above the rear main body; and the groove is provided in the first gripper.

7. The tunnel excavation device according to claim 2, wherein the groove portion includes a second groove portion extending forward from a rear portion of the gripper main body; and the wheel portion includes a second wheel portion mounted detachably to the second groove portion from the rear portion of the gripper main body.

8. The tunnel excavation device according to claim 7, wherein the wheel portion includes a wheel, a carrier rotatably holding the wheel, and a pair of protrusions protruding from the carrier;

the pair of protrusions engage with a pair of engagement grooves; and the pair of engagement grooves are respectively provided on a pair of side walls of the groove portion.

9. The tunnel excavation device according to claim 8, wherein the gripper portion includes a first gripper disposed below the rear main body and a second gripper disposed above the rear main body; and the groove is provided in the first gripper.

10. The tunnel excavation device according to claim 1, wherein the wheel portion includes a wheel, a carrier rotatably holding the wheel, and a pair of protrusions protruding from the carrier;

the pair of protrusions engage with a pair of engagement grooves; and the pair of engagement grooves are respectively provided on a pair of side walls of the groove portion.

11. The tunnel excavation device according to claim 1, wherein the gripper portion includes a first gripper disposed below the rear main body and a second gripper disposed above the rear main body; and the groove is provided in the first gripper.

* * * * *